US009737914B2

(12) United States Patent
Zhang et al.

(10) Patent No.: US 9,737,914 B2
(45) Date of Patent: Aug. 22, 2017

(54) NOZZLE CLEANING DEVICE AND METHOD OF USING THE SAME

(71) Applicant: Shenzhen China Star Optoelectronics Technology Co., Ltd., Guangdong (CN)

(72) Inventors: Fan Zhang, Guangdong (CN); Wei Yu, Guangdong (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 52 days.

(21) Appl. No.: 14/404,020

(22) PCT Filed: Aug. 1, 2014

(86) PCT No.: PCT/CN2014/083559

§ 371 (c)(1),
(2) Date: Aug. 25, 2015

(87) PCT Pub. No.: WO2016/008176

PCT Pub. Date: Jan. 21, 2016

(65) Prior Publication Data

US 2016/0016208 A1 Jan. 21, 2016

(30) Foreign Application Priority Data

Jul. 16, 2014 (CN) ..... 2014 1 0339473

(51) Int. Cl.
*B05B 15/02* (2006.01)
*B08B 3/12* (2006.01)
(Continued)

(52) U.S. Cl.
CPC ..... *B08B 3/12* (2013.01); *B05B 15/025* (2013.01); *B08B 1/04* (2013.01); *A47L 2601/17* (2013.01); *B08B 3/10* (2013.01)

(58) Field of Classification Search
CPC ..... A47L 15/13; B05B 15/02; B05B 15/025; B08B 3/12
See application file for complete search history.

(56) References Cited

U.S. PATENT DOCUMENTS 5,906,687 A * 5/1999 Masui ..... B08B 1/00 134/1
2006/0102193 A1* 5/2006 Lyubchik ..... A23N 12/02 134/1
2007/0261727 A1* 11/2007 Ho ..... A47L 15/13 134/184

FOREIGN PATENT DOCUMENTS

CN 1469783 1/2004
CN 1608749 4/2005
(Continued)

OTHER PUBLICATIONS

International Search Report and the Written Opinion Dated Jan. 21, 2015 From the State Intellectual Property Office of the People's Republic of China Re. Application No. PCT/CN2014/083559 and Its Translation of Search Report in English.

*Primary Examiner* — Randall Chin

(57) ABSTRACT

A nozzle cleaning device and a method of using the same are disclosed. The nozzle cleaning device has a cavity and a sealed chamber formed therein. The sealed chamber is provided with a cleaning tank, motors, driving bearings connected to the motors, rotation shafts connected to the driving bearings, a cleaning block fitted on the rotation shafts disposed above carrier portions, a heating means, and an ultrasonic wave device, so as to thoroughly clean nozzle portions which the mechanical procedure cannot clean, achieving a better cleaning effect, and being easier to use.

8 Claims, 2 Drawing Sheets

(51) Int. Cl.
*B08B 1/04* (2006.01)
*B08B 3/10* (2006.01)

(56) References Cited

FOREIGN PATENT DOCUMENTS

| | | |
|---|---|---|
| CN | 101138757 | 3/2008 |
| CN | 103041943 | 4/2013 |
| CN | 203591909 | 5/2014 |
| CN | 103846183 | 6/2014 |
| JP | 04-826851 | 11/2011 |

* cited by examiner

NOZZLE CLEANING DEVICE AND METHOD OF USING THE SAME

RELATED APPLICATIONS

This application is a National Phase of PCT Patent Application No. PCT/CN2014/083559 having International filing date of Aug. 1, 2014, which claims the benefit of priority of Chinese Patent Application No. 201410339473.4 filed on Jul. 16, 2014. The contents of the above applications are all incorporated by reference as if fully set forth herein in their entirety.

FIELD OF THE INVENTION

The present invention relates to the technical field of organic light emitting display packaging, and in particular, to a nozzle cleaning device and a method of using the same.

BACKGROUND OF THE INVENTION

Recently, glue injection machines have been widely used in a number of production fields. For example, organic light emitting display (OLED) packaging processes and LCD CELL processes are required to use a glue injection machine to bond glass substrates. When the glue injection machine is used for some time or in a standby mode, glue will be left on the nozzle of the glue injection machine, and the accumulation and solidification of the residue glue will affect glue dispensing accuracy, and clog the nozzle.

Since the OLED packaging process is under a nitrogen environment, when replacing the nozzle, a glove box is needed in the conventional art; the nozzle assembly which needs to be cleaned adopts a manual cleaning method, which takes time and effort. If the cleaning is not complete, it will affect the process commissioning, and glue dropping anomalies will therefore affect product quality.

As mentioned above, the following problems exist in the conventional art, during the use of the glue injection machine, the nozzle is not able to be effectively and thoroughly auto-cleaned, hence the glue dropping is not smooth or is clogged, thereby affecting production efficiency and product quality.

SUMMARY OF THE INVENTION

One object of the present invention is to provide a nozzle cleaning device which can be automatically and thoroughly cleaned, so as to be cleaner and easier to use.

In order to solve the above problem, a technical solution according to one embodiment of the present invention is as follows:

The present invention provides a nozzle cleaning device for cleaning a nozzle of a workbench, the workbench is provided with a machine head where the nozzle is disposed, wherein the cleaning device comprises: a cavity; a sealing layer formed within the cavity and defining a sealed chamber, with a bottom of cavity parallel to the sealing layer, in which a heating means is disposed and includes a heating plate and a heating circuit coupled to the heating plate affixed to a bottom of the sealing layer; a first and a second supporting walls oppositely formed above the sealing layer and defining a cleaning tank, with an inner wall of the cavity, configured to place a cleaning liquid therein; and an inlet pipe disposed within the cavity and extended from an outer portion of cavity to the cleaning tank through a sidewall of the cavity and the second supporting wall; a first fixing bar disposed parallel to the sealing layer, one end of which is fixedly connected to the inner wall of the cavity, and the other end of which is connected to a first carrier portion where a first motor, a first driving bearing connected to the first motor, a first rotation shaft connected to the first driving bearing and a first cleaning block fitted on the first rotation shaft are disposed thereabove; and an ultrasonic wave device formed in the sealed chamber comprising an ultrasonic wave generator and an ultrasonic wave transducer connected to the ultrasonic wave generator.

To solve the above problem, the present invention provides a nozzle cleaning device for cleaning a nozzle of a workbench, the workbench is provided with a machine head where the nozzle is disposed.

The cleaning device comprises: a cavity; a sealing layer formed within the cavity and defining a sealed chamber, with a bottom of the cavity parallel to the sealing layer; a first and a second supporting walls oppositely formed above the sealing layer and defining a cleaning tank, with an inner wall of the cavity, configured to place a cleaning liquid therein; a first fixing bar disposed parallel to the sealing layer, one end of which is fixedly connected to the inner wall of the cavity, and the other end of which is connected to a first carrier portion where a first motor, a first driving bearing connected to the first motor, a first rotation shaft connected to the first driving bearing and a first cleaning block fitted on the first rotation shaft are disposed thereabove; and an ultrasonic wave device formed in the sealed chamber, comprising an ultrasonic wave generator and an ultrasonic wave transducer connected to the ultrasonic wave generator.

In order to solve the above problem, the present invention also provides a method for cleaning a nozzle of a workbench by using a nozzle cleaning device, the workbench is provided with a machine head where the nozzle is disposed.

The cleaning device comprises: a cavity; a sealing layer formed within the cavity defining a sealed chamber, with a bottom of the cavity parallel to the sealing layer; a first and a second supporting walls oppositely formed above the sealing layer and defining a cleaning tank, with an inner wall of the cavity, configured to place a cleaning liquid therein; a first fixing bar disposed parallel to the sealing layer, one end of which is fixedly connected to the inner wall of the cavity, and the other end of which is connected to a first carrier portion where a first motor, a first driving bearing connected to the first motor, a first rotation shaft connected to the first driving bearing and a first cleaning block fitted on the first rotation shaft are disposed thereabove; and an ultrasonic wave device formed in the sealed chamber, comprising an ultrasonic wave generator and an ultrasonic wave transducer connected to the ultrasonic wave generator.

The cleaning method comprises the steps of: moving the nozzle into the cleaning device by manipulating the machine head such that the cleaning nozzle is in contact with the first cleaning block; actuating the first motor to rotate the first driving bearing by which the first rotation shaft is rotated, such that the first rotation shaft rotates the first cleaning block to rub the nozzle for clean; moving the nozzle into the cleaning tank by the machine head, and actuating the ultrasonic wave generator to generate a high frequency oscillation to clean the nozzle.

The present invention provides an nozzle cleaning device and a method of using the same, by adopting a mechanical procedure to achieve auto-cleaning, and adding an ultrasonic wave device to thoroughly clean nozzle portions where the mechanical procedure cannot clean, thus reaching a better clean effect, and is easier to use.

DETAILED DESCRIPTION OF THE PREFERRED EMBODIMENTS

The following descriptions for the respective embodiments are specific embodiments capable of being implemented for illustrations of the present invention, with reference to the appended figures. The terms up, down, front, rear, left, right, interior, exterior, side, etcetera are merely directions referring to the appended figures. Therefore, such directions are employed for explaining and understanding the present invention, but are not limitations thereto.

Figure 1:
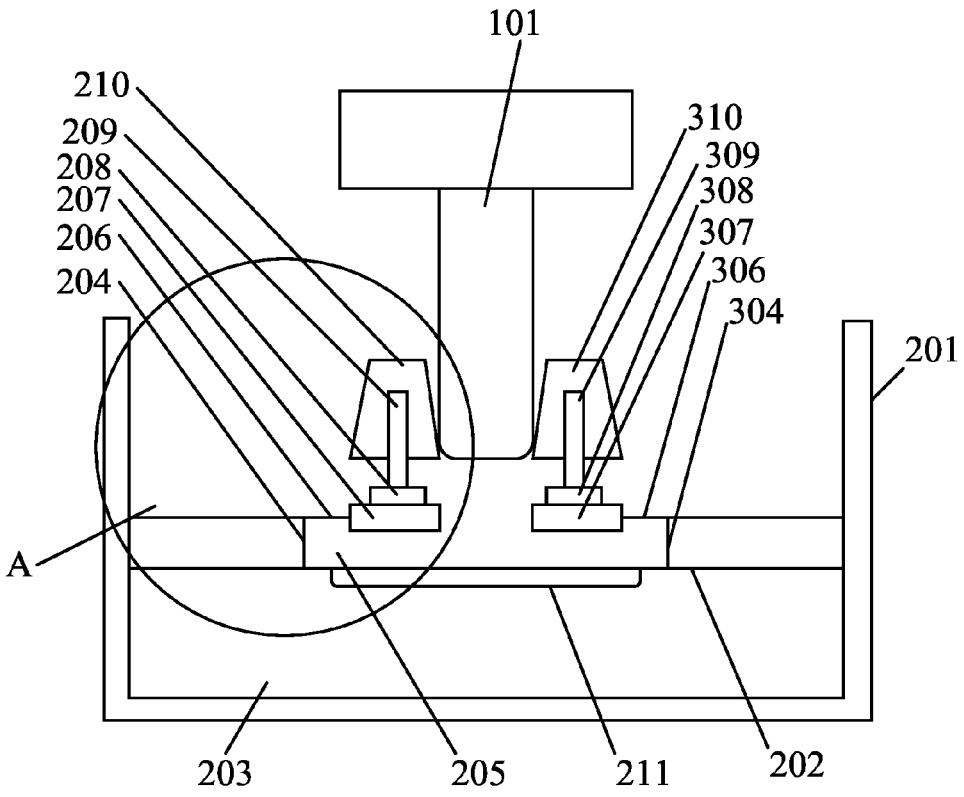
FIG. 1 is a schematic diagram of a nozzle cleaning device according to the present invention.

FIG. 1 is a schematic diagram of a nozzle cleaning device according to the present invention.

Figure 2:
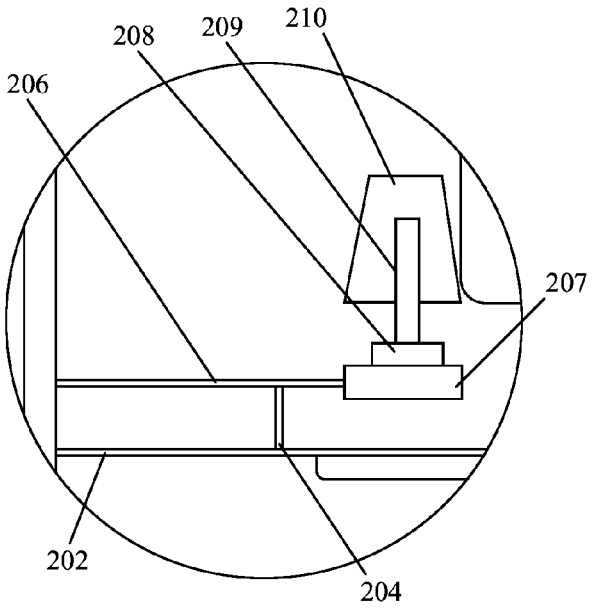
FIG. 2 is a partial enlarged diagram of location A in FIG. 1.

As shown in FIGS. 1 and 2 (where, FIG. 2 is a partial enlarged diagram of location A in FIG. 1), the nozzle cleaning device of the present invention is configured to clean a nozzle 101 of a workbench, the workbench is provided with a machine head where the nozzle 101 is disposed. The cleaning device comprises the followings.

A cavity 201 is an open topped tank shape, or an open topped square shape.

A sealing layer 202 is formed within the cavity 201 and defines a sealed chamber 203, with a bottom of the cavity parallel to the sealing layer. The sealing layer 202 can be fixed in the cavity 201 by welding; the sealing layer 202 also can be fixed using an adhesive sealant, or can be embedded in a sealed ring disposed in the side wall of the cavity 201.

A first supporting wall 204 and the second supporting wall 304 are oppositely formed above the sealing layer 202 and defines a cleaning tank 205, with an inner wall of the cavity 201, configured to place a cleaning liquid therein. The cleaning tank 205 has a smooth inner wall to facilitate cleaning the glue residue on the inner wall of the cleaning tank 205.

A first fixing bar 206 is disposed parallel to the sealing layer 202, one end of which is fixedly connected to the inner wall of the cavity 201, and the other end of which is connected to a first carrier portion 207. A tank shaped mounting position is formed above the first carrier portion 207.

A first motor 208, a first driving bearing connected to the first motor 208, a first rotation shaft 209 connected to the first driving bearing, and a first cleaning block 210 fitted on the first rotation shaft 209 are disposed above the first carrier portion 207, and the first cleaning block is a sponge material. The first motor 208 is respectively connected to the mounting position. For example, a screw thread is provided on an inner wall of the mounting position, and the first motor 208 is provided with another screw thread corresponding to the screw thread on the inner wall, the first motor 208 is then connected to the screw thread of the mounting position. Of course, the first motor 208 can also be connected to the mounting position by welding, engaging, or mounting.

An ultrasonic wave device (not shown in the Figs.) is formed in the sealed chamber 203, comprising an ultrasonic wave generator and an ultrasonic wave transducer connected to the ultrasonic wave generator. A supporting bar for supporting the ultrasonic wave device is disposed in the sealed chamber 203, the ultrasonic wave device is disposed on the top of the supporting bar, and supporting legs of the supporting bar are fixed to the bottom of the sealed chamber 203.

Preferably, the cleaning device further comprises a second fixing bar 306 disposed parallel to the sealing layer 202, one end of which is fixedly connected to the inner wall of the cavity 201, and the other end of which is connected to a second carrier portion 307 where a second motor 308, a second driving bearing connected to the second motor 308, a second rotation shaft 309 connected to the second driving bearing, and a second cleaning block 310 fitted on the second rotation shaft 309 are disposed thereabove. For example, the first cleaning block 210 and the second cleaning block 310 can simultaneously clean two portions of the nozzle 101, thereby reducing cleaning time and enhance the cleaning effect. Likewise, the cleaning device can also provided with a third and a fourth cleaning blocks. Adopting four cleaning blocks to clean four directions of the nozzle saves cleaning time and enhances the cleaning effect.

Preferably, a heating means is disposed in the sealed chamber 203, and includes a heating plate 211 and a heating circuit coupled to the heating plate affixed to the bottom of the sealing layer 202. The heating plate can be replaced with an electric heating wire, and the electric heating wire is spirally disposed and affixed to the bottom of the sealing layer 202.

Preferably, an inlet pipe is disposed within the cavity 201 and extended from an outer portion of cavity 201 to the cleaning tank 205 through a sidewall of the cavity 201 and the second supporting wall. The inlet pipe is configured to convey the cleaning liquid to the cleaning tank 205.

Preferably, a liquid discharging tube is disposed within the cleaning tank 205 and extended to the outer portion of the cavity 201 through the first supporting wall 304 and the side wall of the cavity 201 for discharging the wastewater of the cleaning tank 205.

Preferably, a filter 201 disposed in the cleaning tank 205 parallel to the bottom of the cavity 201 is configured to block impurities, such as the removed glue, so as to prevent the impurities from clogging the liquid discharging tube, resulting in difficulties discharging the wastewater.

Preferably, a cross section of the first cleaning block 210 is triangle or quadrangle perpendicular to bottom of the cavity, and the cross section of the first cleaning block 210 is triangle or quadrangle, where two sides of the triangle or the quadrangle are symmetrical from its central axis, such that when the first cleaning block rotates, the contact area of the first cleaning block 210 to the nozzle 101 would be the same, so as to reach a better cleaning effect. Similarly, the cross section of the first cleaning block 210 can also be rectangular, square, or isosceles trapezoid.

Preferably, the first rotation shaft 209 is a prism, thus increasing friction force between the first rotation shaft 209 and the first cleaning block 210; this avoids the first cleaning block 210 slipping, which affects the cleaning efficiency. For example, the surface of the first rotation shaft 209 has a plurality of rectangular projections; the surface of the first rotation shaft 209 is provided with a plurality of vertically elongated ribs.

The working principle of the cleaning device in the present invention is: disposing the cleaning device on one side of the machine head, the machine head controls the nozzle 101 to inject glue when the nozzle is in a suspend state, moving one side of the nozzle 101 into the cleaning device by manipulating the machine head, such that the cleaning nozzle 101 is in contact with the first cleaning block 210, which rotates to rub the nozzle 101 for clean.

When the nozzle 101 is coated with solidified glue, using only the first cleaning block 210 cannot thoroughly clean the nozzle 101 (i.e. a first cleaning procedure). Therefore a second cleaning procedure is needed, i.e. the machine head controls the nozzle 101 to move downward to the cleaning tank 205, and the heating means disposed on the bottom of the cleaning tank 205 heats the cleaning liquid. The heated cleaning liquid can rapidly melt the glue on the nozzle 101. Meanwhile the ultrasonic wave generator generates a high-frequency oscillation signal, and the high-frequency oscillation signal is converted into a high frequency mechanical vibration by the ultrasonic transducer. The mechanical vibration can oscillate the cleaning liquid, which can clean the nozzle portions which the first cleaning block 210 cannot clean, and thereby the glue in the cracks of the nozzle 101 can be deeply cleaned.

In practice, the above cleaning procedures can be combined or separately used to achieve the best cleaning effect according to the cleanliness of the nozzle 101. The above cleaning procedures can use two or more cleaning blocks, the working principle of the second cleaning block 310 (or a third and a fourth cleaning blocks) is the same as the first cleaning block, which will not be described herein.

The present invention provides an nozzle cleaning device by adopting a mechanical procedure to achieve auto-cleaning, and by adding an ultrasonic wave device to thoroughly clean nozzle portions which the mechanical procedure cannot clean a better clean effect is achieved, and it is easier to use.

Figure 3:
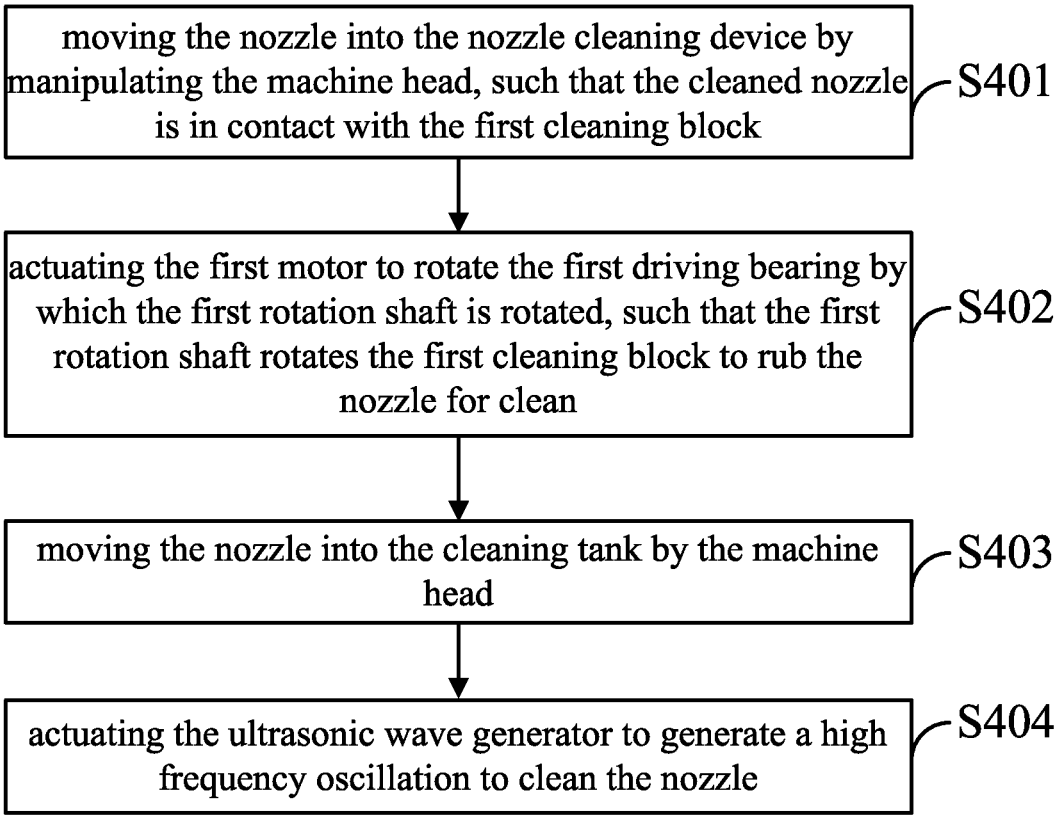
FIG. 3 is a flow chart of a nozzle cleaning method by using a nozzle cleaning device of the present invention.

FIG. 3 is a flow chart of a nozzle cleaning method by using a nozzle cleaning device of the present invention.

As shown in FIG. 3, a method for cleaning the nozzle by using a nozzle cleaning device provided by the present invention is configured to clean a nozzle of a workbench, the workbench is provided with a machine head where the nozzle is disposed. Together with FIGS. 1 and 2, the cleaning device comprises the followings.

A cavity 201 is an open topped tank shape, or an open topped square shape.

A sealing layer 202 is formed within the cavity 201 and defines a sealed chamber 203, with a bottom of the cavity 201 parallel to the sealing layer. The sealing layer 202 can be fixed in the cavity 201 by welding, and can also be fixed using an adhesive sealant, or can be embedded in a sealed ring disposed in the side wall of the cavity 201.

A first supporting wall 204 and the second supporting walls 304 are oppositely formed above the sealing layer 202 and defines a cleaning tank 205, with an inner wall of the cavity 201, configured to place a cleaning liquid therein. The cleaning tank 205 has a smooth inner wall to facilitate clean the glue residue on the inner wall of the cleaning tank 205.

A first fixing bar 206 is disposed parallel to the sealing layer 202, one end of which is fixedly connected to the inner wall of the cavity 201, and the other end of which is connected to a first carrier portion 207. A tank shaped mounting position is formed above the first carrier portion 207.

A first motor 208, a first driving bearing connected to the first motor 208, a first rotation shaft 209 connected to the first driving bearing, and a first cleaning block 210 fitted on the first rotation shaft 209 are disposed above the first carrier portion 207. The first cleaning block is a sponge material; the first motor 208 is respectively connected to the mounting position. For example, a screw thread is provided on an inner wall of the mounting position, and the first motor 208 is provided with another screw thread corresponding to the screw thread on the inner wall, the first motor 208 is then connected to the screw thread of the mounting position. Of course, the first motor 208 can also be connected to the mounting position by welding, engaging, or mounting.

An ultrasonic wave device is formed in the sealed chamber 203, comprising an ultrasonic wave generator and an ultrasonic wave transducer connected to the ultrasonic wave generator. A supporting bar for supporting the ultrasonic wave device is disposed in the sealed chamber 203, the ultrasonic wave device is disposed on the top of the supporting bar, and supporting legs of the supporting bar are fixed to the bottom of the sealed chamber 203.

The method for cleaning the nozzle by using a nozzle cleaning device comprising the steps of: step S401, moving the nozzle into the cleaning device by manipulating the machine head, such that the cleaning nozzle 101 is in contact with the first cleaning block 201; step S402, actuating the first motor 208 to rotate the first driving bearing by which the first rotation shaft 209 is rotated, such that the first rotation shaft 209 rotates the first cleaning block to rub the nozzle for clean; step S403, moving the nozzle 101 into the cleaning tank by the machine head; and step S404, actuating the ultrasonic wave generator to generate a high frequency oscillation to clean the nozzle 101.

Preferably, the cleaning device further comprises a second fixing bar 306 disposed parallel to the sealing layer 202, one end of which is fixedly connected to the inner wall of the cavity 201, and the other end of which is connected to a second carrier portion 307 where a second motor 308, a second driving bearing connected to the second motor, a second rotation shaft 309 connected to the second driving bearing, and a second cleaning block fitted on the second rotation shaft 309 are disposed thereabove. For example, the first cleaning block 210 and the second cleaning block 310 can simultaneously clean two portions of the nozzle 101, thereby reducing the cleaning time and enhance the cleaning effect. Likewise, the cleaning device can also be provided with a third and a fourth cleaning blocks. Adopting four cleaning blocks to clean four directions of the nozzle saves cleaning time, and enhances the cleaning effect.

Preferably, a heating means is disposed in the sealed chamber 203, and includes a heating plate 211 and a heating circuit coupled to the heating plate affixed to the bottom of the sealing layer 202. The heating plate can be replaced with an electric heating wire. The electric heating wire is spirally disposed and affixed to the bottom of the sealing layer 202.

Preferably, an inlet pipe is disposed within the cavity 201 and extended from an outer portion of cavity 201 to the cleaning tank 205 through a sidewall of the cavity 201 and the second supporting wall 304. The inlet pipe is configured to convey the cleaning liquid to the cleaning tank 205.

Preferably, a liquid discharging tube is disposed within the cleaning tank 205 and extended to the outer portion of the cavity 201 through the first supporting wall 304 and the side wall of the cavity 201 for discharging the wastewater of the cleaning tank 205.

Preferably, a filter disposed in the cleaning tank 205 parallel to the bottom of the cavity 201 is configured to block impurities, such as the removed glue, so as to prevent the impurities from clogging the liquid discharging tube, resulting in wastewater which is difficult to discharge.

Preferably, a cross section of the first cleaning block 210 is triangle or quadrangle perpendicular to the bottom of the cavity, the cross section of the first cleaning block 210 is a triangle or a quadrangle, where two sides of the triangle or the quadrangle are symmetrical from its central axis, such that when the first cleaning block rotates, the contact area of the first cleaning block 210 to the nozzle 101 would be the same, so as to reach a better cleaning effect. Similarly, the cross section of the first cleaning block 210 can also be rectangular, square, and isosceles trapezoid.

Preferably, the first rotation shaft 209 is a prism, thus increasing the friction force between the first rotation shaft 209 and the first cleaning block 210. This avoids the first cleaning block 210 slipping, which affects the cleaning efficiency. For example, the surface of the first rotation shaft 209 has a plurality of rectangular projections. The surface of the first rotation shaft 209 is provided with a plurality of vertically elongated ribs.

The present invention provides a nozzle cleaning device and a method of using the same. By adopting a mechanical procedure to achieve auto-cleaning, and by adding an ultrasonic wave device to thoroughly clean nozzle portions which the mechanical procedure cannot clean, a better clean effect is achieved, and it is easier to use.

In view of the working principle of the cleaning device having been described above, it will not be repeated herein.

As is understood by a person skilled in the art, the foregoing preferred embodiments of the present invention are illustrative, rather than limiting, of the present invention. It is intended that they cover various modifications, and similar arrangements be included within the spirit and scope of the appended claims, the scope of which should be accorded the broadest interpretation so as to encompass all such modifications and similar structures.

What is claimed is:

1. A nozzle cleaning device for cleaning a nozzle of a workbench, the working bench being provided with a machine head where the nozzle is disposed, wherein the cleaning device comprises:

a cavity;

a sealing layer formed within the cavity and defining a sealed chamber, with a bottom of the cavity parallel to the sealing layer, in which a heating means is disposed and includes a heating plate and a heating circuit coupled to the heating plate affixed to a bottom of the sealing layer;

a first and a second supporting walls oppositely formed above the sealing layer and defining a cleaning tank, with an inner wall of the cavity, configured to place a cleaning liquid therein; and an inlet pipe disposed within the cavity and extended from an outer portion of cavity to the cleaning tank through a sidewall of the cavity and the second supporting wall;

a first fixing bar disposed parallel to the sealing layer, one end of which is fixedly connected to the inner wall of the cavity, and the other end of which is connected to a first carrier portion where a first motor, a first driving bearing connected to the first motor, a first rotation shaft connected to the first driving bearing and a first cleaning block fitted on the first rotation shaft are disposed thereabove; and an ultrasonic wave device formed in the sealed chamber, comprising an ultrasonic wave generator and an ultrasonic wave transducer connected to the ultrasonic wave generator.

2. The nozzle cleaning device as claimed in claim 1 further comprising a second fixing bar disposed parallel to the sealing layer, one end of which is fixedly connected to the inner wall of the cavity, and the other end of which is connected to a second carrier portion, wherein a second motor, a second driving bearing connected to the second motor, a second rotation shaft connected to the second driving bearing, and a second cleaning block fitted on the second rotation shaft are disposed above the second carrier portion.

3. The nozzle cleaning device as claimed in claim 1, wherein a cross section of the first cleaning block is a triangle or a quadrangle, perpendicular to the bottom of the cavity.

4. A nozzle cleaning device for cleaning a nozzle of a workbench, the working bench being provided with a machine head where the nozzle is disposed, wherein the cleaning device comprises:

a cavity;

a sealing layer formed within the cavity and defining a sealed chamber, with a bottom of the cavity parallel to the sealing layer;

a first and a second supporting walls oppositely formed above the sealing layer and defining a cleaning tank, with an inner wall of the cavity, configured to place a cleaning liquid therein;

a first fixing bar disposed parallel to the sealing layer, one end of the which is fixedly connected to the inner wall of the cavity, and the other end of which is connected to a first carrier portion where a first motor, a first driving bearing connected to the first motor, a first rotation shaft connected to the first driving bearing, and a first cleaning block fitted on the first rotation shaft are disposed thereabove; and an ultrasonic wave device formed in the sealed chamber, comprising an ultrasonic wave generator and an ultrasonic wave transducer connected to the ultrasonic wave generator.

5. The nozzle cleaning device as claimed in claim 4 further comprising a second fixing bar disposed parallel to the sealing layer, one end of which is fixedly connected to the inner wall of the cavity, and the other end of which is connected to a second carrier portion, wherein a second motor, a second driving bearing connected to the second motor, a second rotation shaft connected to the second driving bearing, and a second cleaning block fitted on the second rotation shaft are disposed above the second carrier portion.

6. The nozzle cleaning device as claimed in claim 4, wherein a heating means is disposed in the sealed chamber, and includes a heating plate and a heating circuit coupled to the heating plate affixed to the bottom of the sealing layer.

7. The nozzle cleaning device as claimed in claim 4, wherein an inlet pipe is disposed within the cavity and extended from an outer portion of cavity to the cleaning tank through a sidewall of the cavity and the second supporting wall.

8. The nozzle cleaning device as claimed in claim 4, wherein a cross section of the first cleaning block is a triangle or a quadrangle perpendicular to the bottom of the cavity.

* * * * *